US006659139B2

(12) United States Patent
Laycock et al.

(10) Patent No.: US 6,659,139 B2
(45) Date of Patent: Dec. 9, 2003

(54) WARP-STRETCH WOVEN FABRIC AND METHOD FOR MAKING SAME

(75) Inventors: Graham H. Laycock, Singapore (SG); Raymond S. P. Leung, Shatin New Territories (HK); Tianyi Liao, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 118 days.

(21) Appl. No.: 10/051,580

(22) Filed: Jan. 18, 2002

(65) Prior Publication Data

US 2003/0136459 A1 Jul. 24, 2003

(51) Int. Cl.[7] ..... D03D 15/08

(52) U.S. Cl. ..... 139/422; 139/383 R; 139/420 R; 139/421

(58) Field of Search ..... 139/420 R, 421, 139/422, 383 R; 428/373; 66/192

(56) References Cited

U.S. PATENT DOCUMENTS 2,595,778 A * 5/1952 Duckoff ..... 28/155
3,169,558 A 2/1965 Aleixo et al.
3,387,448 A * 6/1968 Latham et al. ..... 57/225
3,922,888 A * 12/1975 Patterson ..... 66/192
4,164,963 A 8/1979 Black
4,282,906 A * 8/1981 Black ..... 139/422
5,698,321 A * 12/1997 Selivansky ..... 428/373

FOREIGN PATENT DOCUMENTS

| | | |
|---|---|---|
| GB | 1513273 | 6/1978 |
| GB | 2201976 A | 9/1988 |
| JP | 38-31158 | 6/1972 |
| JP | 2-86079 | 12/1991 |

OTHER PUBLICATIONS

Anonymous, 25848 Tool Setting Fixutre, Research Disclosure, Oct. 1985.

* cited by examiner

*Primary Examiner*—John J. Calvert
*Assistant Examiner*—Robert H. Muromoto, Jr.

(57) ABSTRACT

A warp-stretch twill fabric having a face side and a back side and comprising non-elastomeric ends and bare elastomeric ends wherein the ratio of non-elastomeric ends to bare elastomeric ends is from abut 2:1 to about 6:1; an elastomeric end face exposure count of 2 occurs less frequently than once per 10 picks; and the elastomeric ends float over no more than 3 picks on the face side.

10 Claims, 7 Drawing Sheets

WARP-STRETCH WOVEN FABRIC AND METHOD FOR MAKING SAME

BACKGROUND OF THE INVENTION

1. Field of the Invention

The present invention relates to warp-stretch woven fabrics, particularly to twill fabrics comprising bare elastomeric ends.

2. Description of Background Art

Warp-stretch fabrics are disclosed in Japanese Patent Applications JP47-021274 and JP3-287833, in which the elastomeric fibers providing the stretch have been covered with a non-elastomeric fiber such as a nylon or polyester to make a combination yarn, and then sizing, drying, and warping the combination yarn before weaving. These preparation steps make the elastomeric fiber more costly.

U.S. Pat. No. 3,169,558 discloses fabrics in which the spandex is twisted before being woven in a leno construction to avoid elastomeric fiber slippage and to close pinholes in the fabric. However, leno fabrics are generally too open-textured for use in apparel, and they are expensive.

British Patent 2,201,976, U.S. Pat. No. 4,164,963, and Research Disclosure 25849 (October 1985) disclose warp-stretch plain woven narrows for waistbands or bandages in which the elastane yarns are exposed on the face of the fabric. Such exposure is unacceptable in apparel fabrics, due to undesirable "grin-through" of the elastane.

British Patent 1,513,273 exemplifies warp-stretch plain wovens in which the spandex is bare, but such fabrics can also exhibit grin-through.

Improved warp-stretch twills are still needed.

SUMMARY OF THE INVENTION

The present invention provides a warp-stretch twill fabric having a face side and a back side and comprising non-elastomeric ends and bare elastomeric ends wherein:

- a ratio of non-elastomeric ends to elastomeric ends is at least about 2:1;
- a ratio of non-elastomeric ends to elastomeric ends is no higher 10 than about 6:1;
- an elastomeric end face exposure count of 2 is less frequent than once per 10 picks; and
- the elastomeric ends float over no more than 3 picks on the face side.

DETAILED DESCRIPTION OF THE INVENTION

Figure 1:
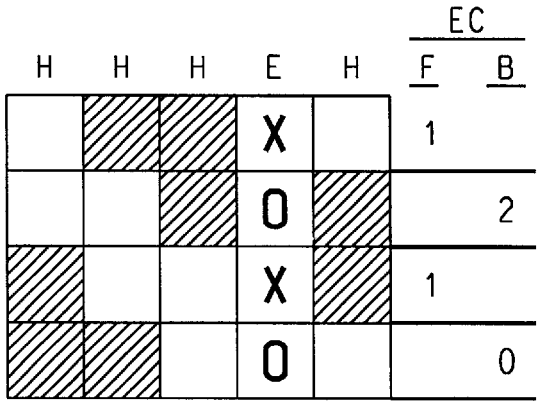
FIGS. 1, 2, 3, 6, 6A, 7, 8, 10, and 15 through 20 illustrate weaving lift plans for fabrics of the invention.

This invention provides warp-stretch woven twill fabrics, including regular, herringbone, and pointed twills made from bare elastomeric ends that exhibit little or no grin-through.

Regular twills can include 2/1, 1/2, 1/3, and 2/2 twills. Modified twills, in which additional lifts have been added to the plan, are also within the scope of the present invention. It was also surprising that such fabrics could be made with low slippage of the bare elastomeric ends, because it was believed that frequent weaving of the warp and weft fibers (ends and picks, respectively), a characteristic of plain wovens and similar constructions, was necessary to control slippage.

As used herein, "bare elastomeric end" means a warp-direction uncovered continuous filament (optionally a coalesced multifilament) or a plurality of filaments which, free of diluents, has a break elongation in excess of 100% independent of any crimp and which when stretched to twice its length, held for one minute, and then released, retracts to less than 1.5 times its original length within one minute of being released. Such filaments include, but are not limited to, rubber filament, spandex, biconstituent filament, and elastoester.

"Spandex" means a manufactured filament in which the filament-forming substance is a long chain synthetic polymer comprised of at least 85% by weight of a segmented polyurethane.

"Elastoester" means a manufactured filament in which the fiber forming substance is a long-chain synthetic polymer composed of at least 50% by weight of aliphatic polyether and at least 35% by weight of polyester. "Biconstituent filament" means a continuous filament comprising at least two polymers adhered to each other along the length of the filament, each polymer being in a different generic class, for example an elastomeric polyetheramide core and a polyamide sheath with lobes or wings.

"Grin-through" is a term used to describe the exposure, in a fabric, of bare elastomeric filaments to view. Grin-through can manifest itself as an undesirable glitter. If a choice must be made, low grin-through on the face side is more desirable than low grin-through on the back side.

The twill fabric of the present invention comprises non-elastomeric ends and bare elastomeric ends. The picks can be elastomeric or non-elastomeric. The ends and picks can be one or more types of elastomeric and non-elastomeric yarns and filaments. The ratio of non-elastomeric to elastomeric ends is typically at least about 2:1 and generally no higher than about 6:1, preferably at least about 3:1 and no higher than about 4:1. When the ratio is too low, the elastomeric ends can be excessively exposed to the surface of the fabric, resulting in undesirable visual and tactile aesthetics. When the ratio is too high, the fabric can have undesirably low stretch-and-recovery properties.

The elastomeric ends float over no more than 3 picks on the face side of the fabric, preferably no more than 2 picks. It is preferred that the elastomeric ends also float over the picks on the back side for no more than 3 picks and more preferably for no more than 2 picks. When the elastomeric end float is too long, the fabric can have an uneven surface, and grin-through can become unacceptable. It is not necessary that the bare elastomeric ends be twisted. To reduce snagging, it is preferred that each pick float over no more than 5 ends on the face side.

"Elastomeric end exposure count" denotes the number of non-elastomeric ends adjacent to each elastomeric end which are on the opposite side of the pick yarn or continuous filament at a given pick, compared to the elastomeric end. The count can be for the face or the back of the fabric, depending on whether the elastomeric end is on the face or the back at the pick in question, and can have integral values of zero, one, or two. When the face of the fabric is being observed, the elastomeric end face exposure count is considered, and similarly for the back. For example, in the lift plan shown in FIG. 1, four non-elastomeric ends are shown in a 2/2 twill pattern into which one bare elastomeric yarn end has been woven. "H" indicates a non-elastomeric ('hard') end, and "E" indicates a bare elastomeric end. "EC" is an abbreviation for exposure count, "F" for face side, and "B" for back side. As in all the Figures, a filled square indicates a non-elastomeric end passing over a pick, an empty square indicates a non-elastomeric end passing under a pick, an "X" indicates a bare elastomeric end passing over a pick, and an "O" indicates a bare elastomeric end passing under a pick. The numbers indicate the elastomeric end exposure count for each pick. At the first pick of the pattern repeat, the bare elastomeric end is on the face side of the fabric, and one adjacent non-elastomeric end is on the back side of the fabric, so the elastomeric end face exposure count for that pick is one. At the second pick, the bare elastomeric end is on the back, and both adjacent non-elastomeric ends are on the front, so the back exposure count is two. At the third pick, the bare elastomeric end is on the face and one adjacent non-elastomeric end is on the back, so the elastomeric end face exposure count for that pick is one. At the fourth and last pick of the pattern repeat, the elastomeric end is on the back, as are both adjacent non-elastomeric ends, so the elastomeric end back exposure count is zero.

The fabric of the invention has an elastomeric end face exposure count of two less frequently than once every 10 picks. The fabric preferably has a face exposure count no higher than one in a pattern repeat, and more preferably a face exposure count of zero in a pattern repeat. When an elastomeric end is on the face side, it is preferred that at least one adjacent non-elastomeric end float over at least 2 picks on the face side. When the face exposure count is two at a frequency higher than once per 10 picks, grin-through of the bare elastomeric filament on the face can be unacceptably high, especially when the elastomeric end floats over 2 or 3 picks. It is further preferred that the fabric have an elastomeric end back exposure count no higher than one.

The Figures exemplify weaving lift plans, and each represents a single pattern repeat. FIG. 1 has been described elsewhere herein. Characteristics of fabrics made using the plans of FIGS. 2, 3, 4, and 5, which are lift plans for 2/2 twills in which the elastomeric end is variously woven, are given in the Examples. Characteristics of fabrics made using the plans of FIGS. 6, 6A, 7, 8, and 9, which are lift plans for 3/1 twills (a 1/3 twill in the case of FIG. 9) in which the elastomeric end is variously woven, are also given in the Examples. FIG. 10 is a lift plan for a 1/2/2/3 twill, further described in Example 9. FIGS. 11, 12, 13, and 14 are comparative plans for plain and weft rib fabrics, into which an elastomeric end has been woven; characteristics of fabrics made following these lift plans are also further described in the Examples.

Figure 15:
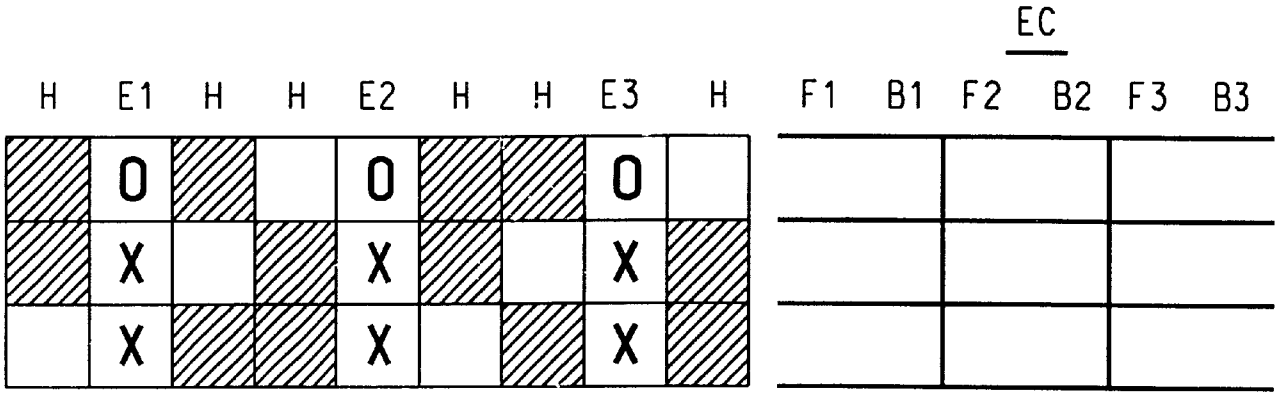

FIG. 15 is a lift plan of a 2/1 twill of the invention in which the lifts of the three bare elastomeric ends in the repeat are not offset from each other. Each of the three bare elastomeric ends in the repeat, which are denoted "E1", "E2", and "E3", has a different exposure count pattern, in which "F1" denotes the elastomeric end face exposure count and "B1" denotes the elastomeric end back exposure count for the first elastomeric end "E1", and so on. The ratio of non-elastomeric ends to elastomeric ends is 2:1, the highest elastomeric end face exposure count is one, the elastomeric ends float over a maximum of two picks on the face side and one pick on the back side, and the maximum pick float is four.

Figure 16:
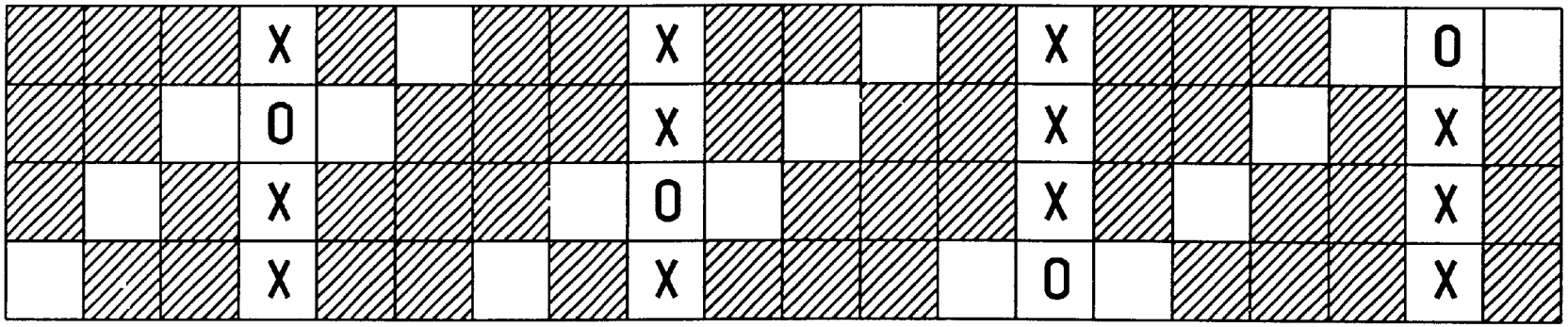

FIG. 16 is a lift plan for a modified 3/1 twill of the invention in which the lifts of the bare elastomeric ends are offset within the repeat. All the bare elastomeric end exposure counts are zero in this fabric, the ratio of non-elastomeric to bare elastomeric ends is 4:1, the elastomeric ends float over a maximum of three picks, and the maximum pick float is five.

Figure 17:
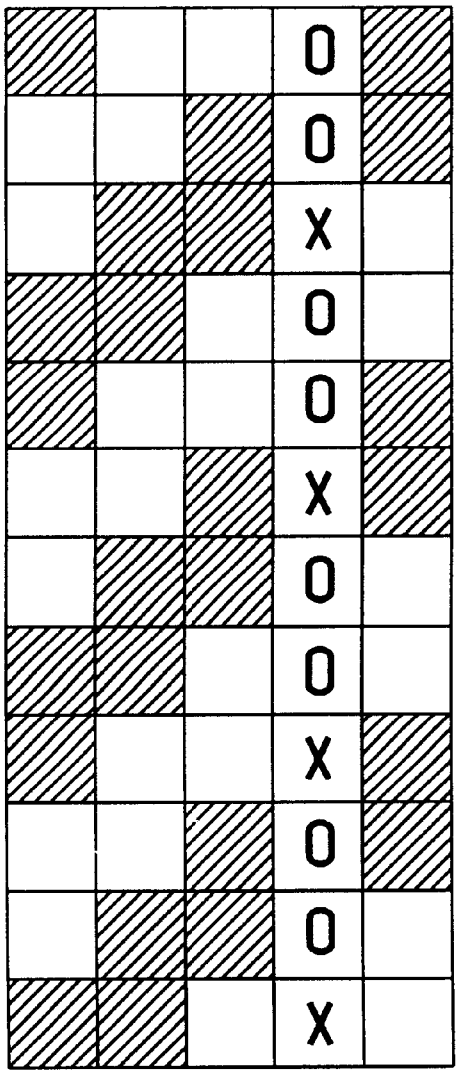

FIG. 17 is a lift plan for a 2/2 twill of the invention in which the ratio of non-elastomeric to bare elastomeric ends is 4:1, an elastomeric end face exposure count of 2 occurs only once every 12 picks, and the elastomeric ends float over up to two picks.

Figure 18:
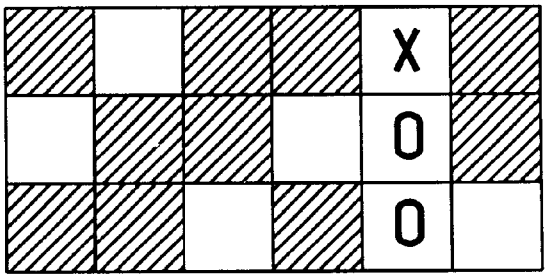

FIG. 18 is a lift plan for a modified 2/1 twill of the invention in which the ratio of non-elastomeric to bare elastomeric ends is 5:1, the highest elastomeric end face exposure count is zero, the elastomeric ends 'float' over one pick on the face side, and the highest pick float is five.

Figure 19:
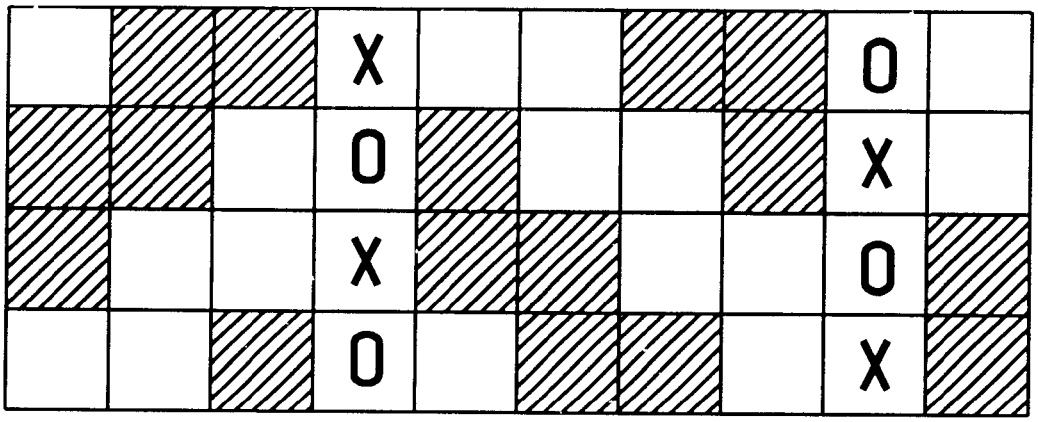

FIG. 19 is a lift plan for a 2/2 herringbone twill of the invention in which the ratio of non-elastomeric to bare elastomeric ends is 4:1, the highest elastomeric end face exposure count is one, the elastomeric ends 'float' over one pick on the face side, the maximum pick face float is three, and, when the elastomeric end is on the face side, at least one adjacent non-elastomeric end floats over two picks.

Figure 20:
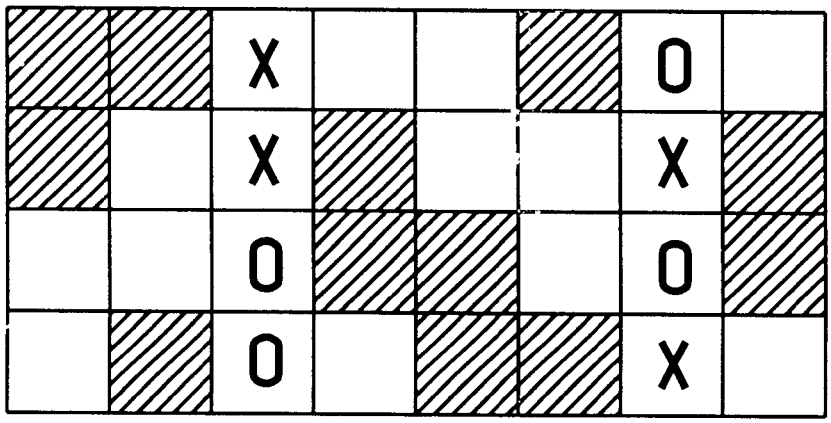
Figure 15:
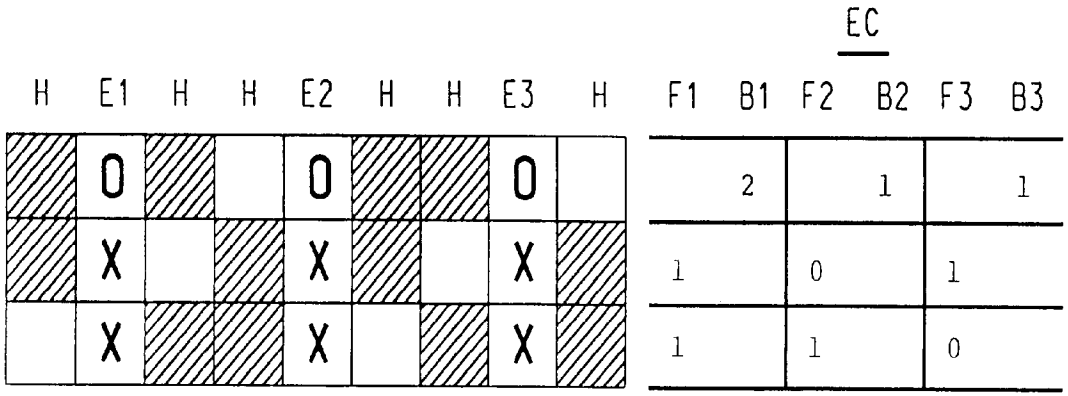
Figure 16:
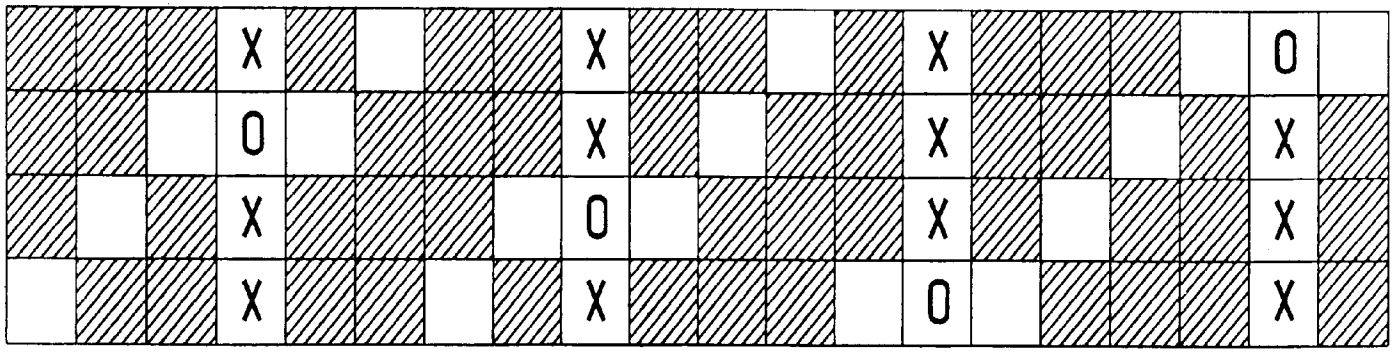

FIG. 20 is a lift plan for a 2/2 pointed twill of the invention in which the ratio of non-elastomeric to bare elastomeric ends is 3:1, the highest elastomeric end face exposure count is one, the elastomeric ends float over no more than 2 picks, the maximum pick face float is three, and, when the elastomeric end is on the face side, at least one adjacent non-elastomeric end floats over two picks.

The fabric of the invention, when finished, preferably has at least about 15% and less than about 50% warp-stretch. Fabric having less than about 15% warp-stretch can have inadequate stretch and recovery, and fabric having more than about 50% warp-stretch can have low recovery upon stretching or washing. Fabric stretch can be adjusted by changing the details of construction, for example pick density, and/or the dyeing and finishing conditions, for example heat-setting.

The fabric of the invention can have single-directional (warp) stretch or bidirectional (warp and weft) stretch. In bi-directional stretch fabrics, the weft direction stretch is also preferably at least about 15%. The fabrics can be about 1—10 wt %, typically about 1.5–5 wt % elastomeric ends, based on the total weight of the fabric.

It was unexpected to find that non-elastomeric ends adjacent to elastomeric ends need not be woven opposite to the elastomeric ends to restrict slippage of the elastomeric ends. If necessary, however, various optional measures can be taken to control such slippage. Such measures include increasing such 'opposite' weaving of an elastomeric end and one of the adjacent non-elastomeric ends, weaving the elastomeric ends 1/1 with respect to the picks, heat-setting the fabric at any point in its processing before it is cut into garment-sized pieces, using a lower elastomeric filament denier, and reducing elastomeric end draft during weaving (without reducing it so much that the weaving process is compromised or the stretch in the final fabric is excessively reduced). Such measures can also be used to improve the flatness of the fabric, especially when the elastomeric ends float over 2 or 3 picks.

There is no particular limitation on the nature of the non-elastomeric ends or picks, and poly(hexamethylene adipamide) fibers, polycaprolactam fibers, poly(ethylene terephthalate) fibers, poly(trimethylene terephthalate) fibers, cotton, wool, linen, rayon, acetate, lyocell, and the like can be used in either or both the warp and weft.

If it is desired to heat-set the fabric and if non-elastomeric fibers are used which can withstand relatively high heat-set temperature, for example poly(hexamethylene adipamide) fiber, conventional spandex can be used, for example Lycra® T-162C or T-902C. Spandex with a higher heat-set efficiency can also be used, for example as disclosed in U.S. Pat. Nos. 5,981,686 and 5,948,875, and U.S. patent application Ser. No. 09/790,422. Especially when non-elastomeric fibers such as polycaprolactam, cotton or wool are used, it is preferred that the spandex have a heat-set efficiency at approximately 175°–190° C. of ≧80%, as measured by 1) mounting the spandex on a 10-cm frame, 2) stretching the spandex 1.5×, 3) placing the frame and spandex horizontally in an oven preheated to 175°–190° C. for 120 seconds, 4) allowing the spandex to relax and the frame to cool to room temperature, 5) immersing the frame and spandex in a boiling water solution containing nonionic detergent for 60 min, 6) placing the frame and spandex in boiling water at pH5 for 30 min, 7) drying the spandex at room temperature, 8) measuring the length of the spandex, and 9) calculating the heat set efficiency according to:

$$HSE\ \% = \frac{\text{heat-set length} - \text{original length}}{\text{stretched length} - \text{original length}} \times 100$$

In order for the elastomeric filament better to withstand the high friction environment of the loom shed, it is preferred that its linear density be about 40–260 denier (44–289 dtex), more preferably 70–180 denier (77–200 decitex).

To reduce the frequency of breaks in the bare elastomeric ends, a number of precautions can be taken, especially when weaving the elastomer with a high friction staple yarn such as cotton or wool. For example, it is preferred that the elastomeric ends be drawn in at the first shaft so they experience as little up/down motion as possible and that as many as possible of the elastomeric ends in each dent be positioned next to the reed wire of the loom. When cotton is used in making the fabric of the present invention, it can be advantageous to reduce levels of cotton fly, which can settle on the bare elastomeric filaments. For example vacuum manifolds can be used at the ends and across the width of the shed, under and over the warp threadsheets.

It is also preferred that the path of the bare elastomeric ends from the guide roller bar of the loom to the beat-up position be substantially horizontal and without unnecessary directional changes and that the elastomeric ends be fed to the loom at a substantially constant draft and speed by using a braking device controlled in common with the loom takeup. The let-off means used to provide the elastomeric warps from the beams can be either "negative" (using a brake to control the speed at which the threadsheet is pulled into the loom by the fabric takeup) or "positive" (using a motor-driven beam rotating at constant speed to control the threadsheet, as described in U.S. Pat. No. 6,216,747). Tension is applied to the elastomeric warp threadsheets between the beam and the loom, and the elastomeric fibers are stretched 10% to 60% of their elongation at break, for example 1.5× to 6×. For example, 140 denier T162C Lycra® spandex can be stretched 1.5×, 2.0× and 2.5× when tensions of 4 gram/end, 7 gram/end and 12 gram/end are applied, respectively.

To measure the elongation of fabrics in the Examples, samples 60 cm long and 6.5 cm wide were cut from the fabric at least 10 cm from the selvage. Three samples were cut for each direction (warp and/or weft) that was to be tested, and the samples were selected from different parts of the fabric to minimize the possibility that two samples might contain the same yarns. The long direction corresponded to the stretch direction to be tested. Each sample was unraveled to 5 cm width, removing about the same number of yarns on each side. One end of each sample was folded back on itself to form a loop, a seam was sewn across the width of the specimen to secure the loop, and a 0.65 cm notch was cut into the loop. At 6.5 cm from the unlooped edge of the fabric a mark "A" was drawn, and at 50 cm from mark "A" (toward the loop) a mark "B" was drawn. Each sample was conditioned for at least 16 hours at 20° C. and 65% relative humidity and then hung vertically with a clamp at mark "A". The position of mark "B" was noted, a metal pin was inserted through the loop, and a 30 N (6.75 pound) weight was hooked through the loop notch and over the metal pin. Each sample was "exercized" by adding and removing the weight three times. The weight was then hung a fourth time on the pin, the distance between marks "A" and "B" was recorded to the nearest millimeter, and the percent fabric elongation was calculated from:

$$\%\ \text{fabric elongation} = \frac{L_w - L_o \times 100}{L_o}$$

wherein $L_W$ is the length between the marks with the weight attached, and $L_O$ is the original length between the marks. The average elongation was calculated for the three samples and reported.

The fabrics in the Examples were visually examined with a lighted magnifier and semi-quantitative grin-through ratings were assigned as follows: '0' (no spandex visible), '1' (spandex occasionally visible), '2' (spandex visible), '3' (spandex regularly visible), '4' (spandex frequently visible), or '5' (spandex almost continuously visible).

Unless otherwise noted, a Rüti L-5000 air-jet loom was used in the Examples. One beam was prepared with 150 denier/50 textured filament poly(ethylene terephthalate) fiber (from Unifi) at 88 ends/inch and 5544 total ends. Three 21-inch (53 cm) long beams with 140 denier (156 dtex) Type 162C Lycra® spandex at 22 ends/inch and 462 ends per beam (1386 ends total) were ganged together. The ratio of non-elastomeric ends to elastomeric ends was 4:1. Unless otherwise noted, 7 g/end tension was applied to the spandex ends. A full-width comb was used on the spandex let-off to resist entanglement among the ends, and a cylindrical steel bar (optionally sprayed with silicone lubricant) was placed across the loom between the non-elastomeric yarn and spandex threadsheets just before they entered the shed. The spandex was drawn into the first harness, and each repeat pattern corresponded to one dent. The weft yarns were woven at 478 picks/minute.

Each greige fabric in the Examples was finished by first passing it under low tension through hot water three times at 160° F., 180° F. and 202° F. (71° C., 82° C., 94° C., respectively). Fabrics containing only synthetic fibers were de-sized and pre-scoured with 6 wt % Synthazyme® (a starch-hydrolyzing enzyme from Dooley Chemicals LLC), 1 wt % Lubit® 64 (nonionic lubricant from Sybron, Inc.), and 0.5 wt % Merpol® LFH (surfactant, a registered trademark of E. I. du Pont de Nemours and Company) at 160° F. (71° C.) for 30 minutes, followed by addition of 0.5 wt % trisodium phosphate; scoured with 1 wt % Lubit® 64 and 1 wt % Merpol® LFH at 110° F. (43° C.) for 5 minutes; jet-dyed with a green, tan, or gray disperse dye at 230° F. (110° C.) for 30 min at pH 5.2; and heat-set on a tenter frame at 380° F. (193° C.) for 40 sec while being underfed in the warp direction. (Weight percents are based on fabric weight.)

Each greige fabric containing cotton was pre-scoured with 3 wt % Lubit® 64 at 120° F. (49° C.) for 10 minutes;

de-sized with 6 wt % Synthazyme® and 2 wt % Merpol® LFH for 30 minutes at 160° F. (71° C.); scoured with 3 wt % Lubit® 64, 0.5 wt % Merpol® LFH and 0.5 wt % trisodium phosphate at 180° F. (82° C.) for 30 minutes; and bleached with 3 wt % Lubit® 64, 15 wt % of 35% hydrogen peroxide, and 3 wt % sodium silicate at pH 9.5 for 60 minutes at 180° F. (82° C.); beck-dyed with a tan, black, or green direct dye at 200° F. (93° C.) for 30 minutes; and heat-set at 380° F. (193° C.) on a tenter frame for 35 seconds with enough tension to hold it straight without underfeeding.

In order to more readily determine grin-through, the spandex in selected samples was additionally dyed red with an acid dye to highlight the spandex.

No slippage was observed for any of the samples made in the Examples. In the Tables, "Comp." indicates a comparison example.

EXAMPLE 1

The lift plan of FIG. 1 was followed to prepare a 2/2 twill warp-stretch fabric from beams of the 140 denier (156 decitex) Type 162C Lycra® spandex (a registered trademark of E. I. du Pont de Nemours and Company) and the 150 denier (167 decitex) textured poly(ethylene terephthalate) yarn from Unifi Inc. The weft yarn was 140 denier (156 decitex), 136 filament air-jet textured poly(ethylene terephthalate) yarn from Unifi. In the finished fabric (dyed gray), the warp density of the poly(ethylene terephthalate) yarn was 99 ends/in (39 ends/cm), the warp density of the spandex was 25 ends/in (10 ends/cm) (total warp density 124 ends/in (49 ends/cm), the weft density of the poly (ethylene terephthalate) yarn was 105 picks/in (41 picks/cm), the basis weight was 6.9 oz/yd$^2$ (235 g/m$^2$), and the warp elongation was 78%. Table I summarizes the results.

EXAMPLE 2

Figure 2:
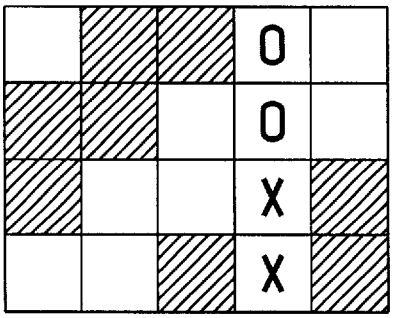

The lift plan of FIG. 2 was followed, using the same warp and weft yarns as in Example 1. In the finished fabric (dyed gray), the warp density of the poly(ethylene terephthalate) yarn was 99 ends/in (39 ends/cm), the warp density of the spandex was 25 ends/in (10 ends/cm) (total warp density 124 ends/in (49 ends/cm), the weft density of the poly (ethylene terephthalate) yarn was 97 picks/in (38 picks/cm), the basis weight was 6.3 oz/yd$^2$ (214 g/m$^2$), and the warp elongation was 66%. Table I summarizes the results.

EXAMPLE 3

Figure 3:
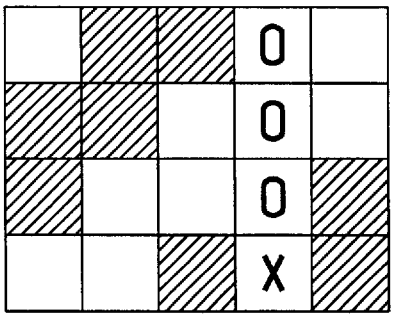

The lift plan of FIG. 3 was followed, using the same warp and weft yarns as in Example 1. In the finished fabric (dyed gray), the warp density of the poly(ethylene terephthalate) yarn was 97 ends/in (38 ends/cm), the warp density of the spandex was 24 ends/in (9 ends/cm) (total warp density 121 ends/in (47 ends/cm), the weft density of the poly(ethylene terephthalate) yarn was 96 picks/in (38 picks/cm), the basis weight was 6.4 oz/yd$^2$ (216 g/m$^2$), and the warp elongation was 65%. Table I summarizes the results.

Comparison Example 1

Figure 4:
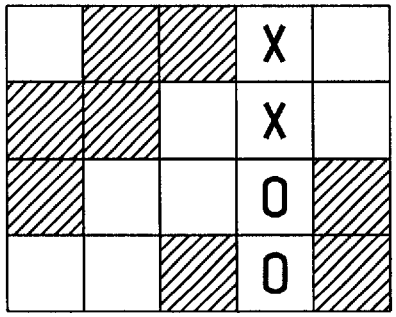
FIGS. 4, 5, 9, and 11 through 14 illustrate comparative weaving lift plans.

The lift plan of FIG. 4 was followed, using the same warp and weft yarns as in Example 1. In the finished fabric (dyed gray), the warp density of the poly(ethylene terephthalate) yarn was 101 ends/in (40 ends/cm), the warp density of the spandex was 24 ends/in (9 ends/cm) (total warp density 125 ends/in (49 ends/cm), the weft density of the poly(ethylene terephthalate) yarn was 102 picks/in (40 picks/cm), the basis weight was 6.38 oz/yd$^2$ (216 g/m$^2$), and the warp elongation was 65%. Table I summarizes the results.

Comparison Example 2

Figure 5:
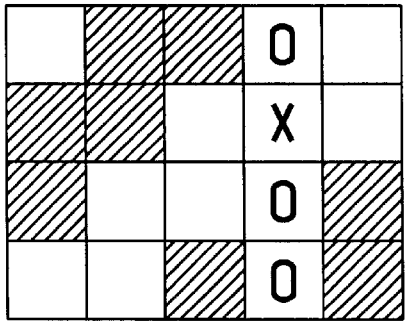

The lift plan of FIG. 5 was followed, using the same warp and weft yarns as in Example 1. In the finished fabric (dyed gray), the warp density of the poly(ethylene terephthalate) yarn was 97 ends/in (38 ends/cm), the warp density of the spandex was 24 ends/in (9 ends/cm) (total warp density 121 ends/in (47 ends/cm), the weft density of the poly(ethylene terephthalate) yarn was 104 picks/in (41 picks/cm), the basis weight was 6.9 oz/yd$^2$ (234 g/m$^2$), and the warp elongation was 75%. Table I summarizes the results.

TABLE I

| Example | 1 | | 2 | | 3 | | Comp. 1 | | Comp. 2 | |
|---|---|---|---|---|---|---|---|---|---|---|
| Minimum non-elastomeric adjacent end face float | 2 | | 2 | | 2 | | 0 | | 0 | |
| | Face | Back | Face | Back | Face | Back | Face | Back | Face | Back |
| Maximum Exposure Count | 1 | 2 | 1 | 1 | 0 | 1 | 2 | 2 | 2 | 2 |
| Maximum spandex end float | 1 | 1 | 2 | 2 | 1 | 3 | 2 | 2 | 1 | 3 |
| Maximum pick float | 3 | 3 | 3 | 3 | 3 | 3 | 3 | 3 | 2 | 3 |
| Grin Through Rating | 1 | 1 | 1 | 1 | 0 | 5 | 4 | 4 | 3 | 5 |

The ratings in Table 1 show that the fabrics in Comparison Examples 1 and 2 had unacceptable and inferior grin-through, compared to the fabrics of the invention in Examples 1, 2, and 3. In each of the fabrics of the invention, the maximum elastomeric face exposure count was one, and the non-elastomeric adjacent end face float was two, but in the Comparison Examples, the face exposure count was two every four picks, and the adjacent non-elastomeric end face float was zero.

EXAMPLE 4

Figure 6:
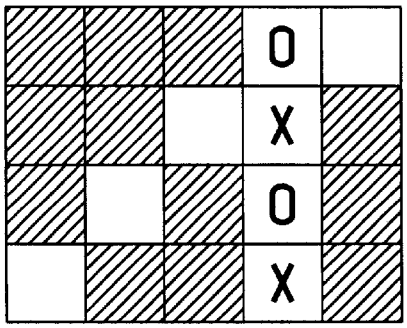

The lift plan of FIG. 6 was followed to prepare a 3/1 twill warp-stretch fabric from the same warp yarns used in Example 1, but the weft yarn was the same as the poly (ethylene terephthalate) warp yarn. Tension (12 g/end) was applied to the spandex so that it was drafted about 2.5×. In the finished fabric, the warp density of the poly(ethylene terephthalate) yarn was 122 ends/in (48 ends/cm), the warp density of the spandex yarn was 30 ends/in (12 ends/cm) (total warp density 152 ends/in (60 ends/cm), and the weft density of the poly(ethylene terephthalate) yarn was 100 picks/in (39 picks/cm). The tan, finished 6.0 oz/yd$^2$ (202 g/m$^2$) fabric had a warp elongation of 28%. Table II summarizes other results.

EXAMPLE 5

The lift plan of FIG. 6 was again followed. An elastomeric warp of 180 denier (200 dtex) Type 902 Lycra® spandex, a non-elastomeric warp of 16 cc cotton, and a weft of 70 denier (78 dtex) Type 162C Lycra® spandex core-spun with 20 cc cotton at a twist multiplier of 4 were used. The black finished 13.7 oz/yd$^2$ (464 g/m$^2$) fabric had a cotton yarn warp density of 127 ends/in (50 ends/cm), a spandex warp density of 32 ends/in (13 ends/cm) for a total of 159 warp ends/in (63 ends/cm), a weft density of 62 picks/in (24 picks/cm), a warp elongation of 21%, and a weft elongation of 19%. Table II summarizes other results.

EXAMPLE 6

The lift plan of FIG. 6 was followed, using 140 denier (156 decitex) Type 162C Lycra® spandex and 150 denier (167 decitex) textured poly(ethylene terephthalate) yarn from Unifi as the elastomeric and non-elastomeric warp yarns, respectively, and a 20 cc cotton weft yarn. The green finished 8.6 oz/yd$^2$ (292 g/m$^2$) fabric had a poly(ethylene terephthalate) yarn warp density of 122 ends/in (48 ends/cm), a spandex warp density of 30 ends/in (12 ends/cm) (total of 152 warp ends/in (60 ends/cm)), a weft density of 93 picks/in (37 picks/cm), and a warp elongation of 38%. Table II summarizes other results.

EXAMPLE 6A

Figure 6A:
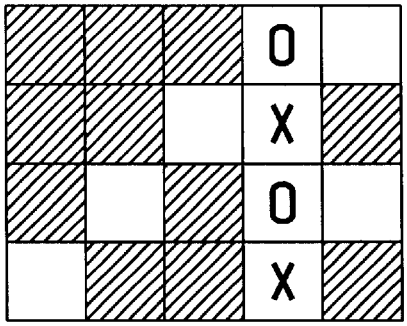

Example 6 was repeated, but following a slightly modified lift plan as shown in FIG. 6A, in which the bare elastomeric back exposure count was reduced by dropping one lift in the third pick of the repeat. In the finished fabric (dyed gray), the warp density of the poly(ethylene terephthalate) yarn was 99 ends/in (39 ends/cm), the warp density of the spandex was 25 ends/in (10 ends/cm) (total warp density 142 ends/in (49 ends/cm), the weft density of the poly(ethylene terephthalate) yarn was 99 picks/in (39 picks/cm), the basis weight was 6.4 oz/yd$^2$ (218 g/m$^2$), and the warp elongation was 69%. Results are reported in Table II.

EXAMPLE 7

Figure 7:
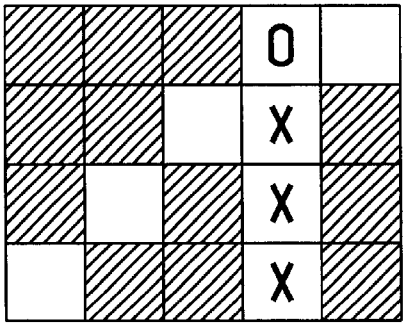

The lift pattern of FIG. 7 was followed to prepare a 3/1 twill, using the same warp and weft yarns as in Example 1. In the finished fabric (dyed gray), the warp density of the poly(ethylene terephthalate) yarn was 100 ends/in (39 ends/cm), the warp density of the spandex was 25 ends/in (10 ends/cm) (total warp density 125 ends/in (41 ends/cm), the weft density of the poly(ethylene terephthalate) yarn was 104 picks/in (49 picks/cm), the basis weight was 6.9 oz/yd$^2$ (216 g/m$^2$), and the warp elongation was 69%. Table II summarizes the results.

EXAMPLE 8

Figure 8:
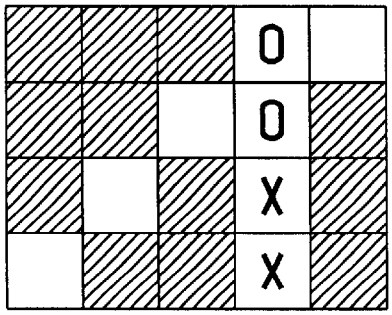

The lift pattern of FIG. 8 was followed to prepare a 3/1 twill, using the same warp and weft yarns as in Example 1. In the finished fabric (dyed gray), the warp density of the poly(ethylene terephthalate) yarn was 100 ends/in (39 ends/cm), the warp density of the spandex was 25 ends/in (10 ends/cm) (total warp density 125 ends/in (49 ends/cm), the weft density of the poly(ethylene terephthalate) yarn was 108 picks/in (43 picks/cm), the basis weight was 6.9 oz/yd$^2$ (235 g/m$^2$), and the warp elongation was 73%. Table II summarizes other results.

Comparison Example 3

Figure 9:
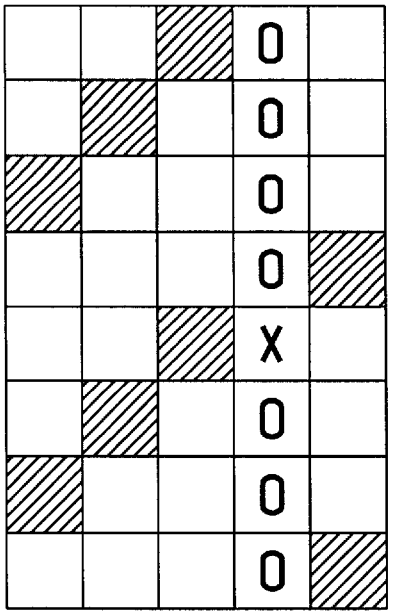
Figure 10:
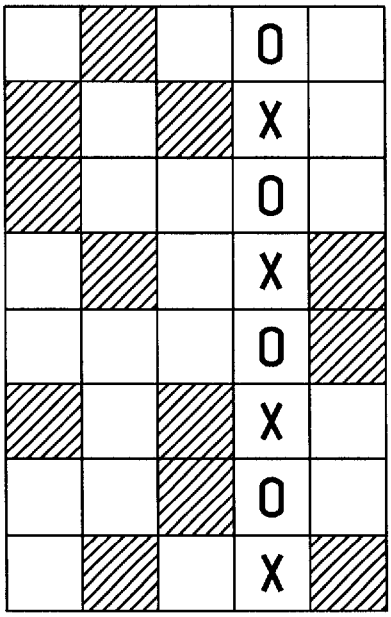

The lift pattern of FIG. 9 was followed to prepare a 1/3 twill using the same warp and weft yarns of Example 1. In the finished fabric (dyed gray), the warp density of the poly(ethylene terephthalate) yarn was 94 ends/in (37 ends/cm), the warp density of the spandex was 24 ends/in (9 ends/cm) (total warp density 118 ends/in (46 ends/cm), the weft density of the poly(ethylene terephthalate) yarn was 103 picks/in (41 picks/cm), the basis weight was 6.6 oz/yd$^2$ (225 g/m$^2$), and the warp elongation was 75%. The fabric was heavily ribbed on the face and showed excessive grin-through on the back. Table II summarizes other results.

TABLE II

| Example | 4 | | 5 | | 6 | | 6A | | 7 | | 8 | | Comp. 3 | |
|---|---|---|---|---|---|---|---|---|---|---|---|---|---|---|
| Minimum non-elastomeric adjacent end face float | 3 | | 3 | | 3 | | 1 | | 3 | | 3 | | 1 | |
| | Face | Back | Face | Back | Face | Back | Face | Back | Face | Back | Face | Back | Face | Back |
| Maximum Exposure Count | 1 | 2 | 1 | 2 | 1 | 2 | 1 | 1 | 1 | 1 | 0 | 1 | 1 | 1 |
| Maximum spandex end float | 1 | 1 | 1 | 1 | 1 | 1 | 1 | 1 | 3 | 1 | 2 | 2 | 1 | 7 |
| Maximum pick float | 4 | 2 | 4 | 2 | 4 | 2 | 4 | 2 | 4 | 2 | 4 | 2 | 2 | 4 |
| Grin Through Rating | 0 | 3 | 0 | 3 | 0 | 3 | 1 | 3 | 0 | 1 | 0 | 4 | 1 | 5 |

The data in Table II show that all of the inventive fabrics had little or no face grin-through. In Example 6A, the non-elastomeric end float adjacent to one of the spandex lifts was reduced to one, and the grin-through rating, while still very acceptable, was also reduced, demonstrating a preference that at least one non-elastomeric end adjacent to the spandex on the face side float over at least two picks. The fabric of Example 7 shows that a spandex float of 3 can give low grin-through and no elastomeric end slippage.

EXAMPLE 9

The lift plan of FIG. 10 was followed to give a 1/2/2/3 twill, using the warp and weft yarns of Example 1. In the finished fabric (dyed gray), the warp density of the poly (ethylene terephthalate) yarn was 98 ends/in (39 ends/cm), the warp density of the spandex was 24 ends/in (9 ends/cm) (total warp density 122 ends/in (48 ends/cm), the weft density of the poly(ethylene terephthalate) yarn was 100 picks/in (39 picks/cm), the basis weight was 6.3 oz/yd$^2$ (214 g/m$^2$), and the warp elongation was 64%. The minimum non-elastomeric adjacent end face float was 2, the maximum exposure counts and maximum spandex end floats on the face and back were all 1, the maximum weft float on the face was 4 and that on the back was 2, the face grin-through rating was 0, and the back grin-through rating was 3. This face of this fabric shows that the twill construction can be modified and without detracting from the benefits of the invention.

Comparison Example 4

Figure 11:
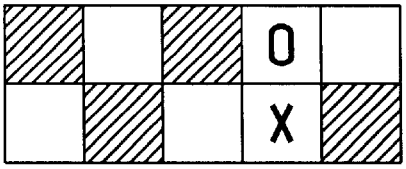

The lift plan of FIG. 11 was followed to make a 1/1 plain fabric, in which an elastomeric warp yarn and a non-elastomeric warp yarn were woven together and therefore 'paired'. The warp yarns were the same as in Example 1. The weft yarn was 140 denier (156 decitex), 100 filament Type 935T poly(ethylene terephthalate) from Unifi. The finished green 6.3 oz/yd$^2$ (214 g/m$^2$) fabric had a total warp density of 125 ends/in (49 ends/cm), a weft density of 99 picks/in (39 picks/cm), and a warp elongation of 48%. Other details and results are given in Table III.

Comparison Example 5

Figure 12:
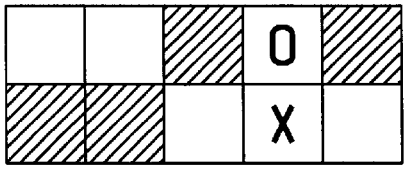

Comparison Example 3 was repeated, but the lift plan of FIG. 12 was followed to make a 2/2 weft rib fabric. The finished green 6.1 oz/yd$^2$ (207 g/m$^2$) fabric had a total warp density of 135 end/in (53 ends/cm), a weft density of 97 picks/in (38 picks/cm), and a warp elongation of 52%. See Table III for further details and results.

Comparison Example 6

Figure 13:
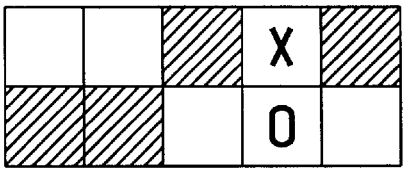

Comparison Example 3 was repeated but following the lift plan of FIG. 13 to make a 2/3 weft rib fabric (sometimes called "oxford", here a 1/1 plain woven with 2 and 3 ends weaving as one). The finished green 7.1 oz/yd$^2$ (241 g/m$^2$) fabric had a total warp density of 144 end/in (57 ends/cm), a weft density of 99 picks/in (39 picks/cm), and a warp elongation of 53%. Results are summarized in Table III.

Comparison Example 7

Figure 14:
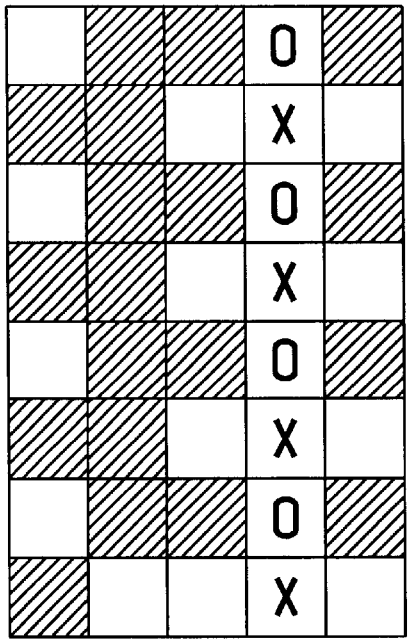

Using the same warp and weft yarns as in Example 1, the lift plan of FIG. 14 was followed to make a combination 1/1 plain and 2/1 weft rib fabric. In the finished fabric (dyed gray), the warp density of the poly(ethylene terephthalate) yarn was 102 ends/in (42 ends/cm), the warp density of the spandex was 25 ends/in (10 ends/cm) (total warp density 127 ends/in (52 ends/cm), the weft density of the poly (ethylene terephthalate) yarn was 85 picks/in (34 picks/cm), the basis weight was 5.8 oz/yd$^2$ (196 g/m$^2$), and the warp elongation was 43%. The fabric face had a ribbed, plush appearance. Other details and results are given in Table III.

TABLE III

| Example | Comp. 4 | | Comp. 5 | | Comp. 6 | | Comp. 7 | |
|---|---|---|---|---|---|---|---|---|
| Minimum non-elastomeric adjacent end face float | 1 | | 0 | | 1 | | 0 | |
| | Face | Back | Face | Back | Face | Back | Face | Back |
| Maximum Exposure Count | 1 | 1 | 2 | 2 | 0 | 0 | 2 | 2 |
| Maximum spandex end float | 1 | 1 | 1 | 1 | 1 | 1 | 1 | 1 |
| Maximum pick float | 2 | 2 | 2 | 2 | 3 | 3 | 2 | 2 |
| Grin Through Rating | 4 | 4 | 5 | 5 | 4 | 4 | 4 | 5 |

The results in Table III show the inadequacy of plain and weft rib constructions in controlling grin-through in wovens made with bare elastomeric ends.

What is claimed is:

1. A warp-stretch twill fabric having a face side and a back side and comprising non-elastomeric ends and bare elastomeric ends wherein:

a ratio of non-elastomeric ends to elastomeric ends is at least about 2:1;

a ratio of non-elastomeric ends to elastomeric ends is no higher than about 6:1;

an elastomeric end face exposure count of 2 occurs less frequently than once per 10 picks; and the elastomeric ends float over no more than 3 picks on the face side.

2. The fabric of claim 1 wherein a pick floats over no more than 5 ends on the face side and, when an elastomeric end is on the face side, at least one non-elastomeric end adjacent to a bare elastomeric end floats over at least 2 picks on the face side.

3. The fabric of claim 1 wherein the elastomeric ends float over no more than 3 picks on the back side.

4. The fabric of claim 2 having:

a weft-stretch of at least about 15%; and a weft-stretch of no more than about 50%.

5. The fabric of claim 2 wherein:

the elastomeric end face exposure count is no higher than one in a pattern repeat;

the fabric has at least about 15% warp-stretch; and the fabric has less than about 50% warp-stretch.

6. The fabric of claim 2 wherein:

the elastomeric ends are present to an extent of at least about 1 percent by total fabric weight;

the elastomeric ends are present to an extent of no more than about 10 percent by total fabric weight; and the elastomeric ends are spandex.

7. The fabric of claim 2 wherein:

at least one of a) the non-elastomeric ends and b) the picks are selected from the group consisting of cotton and wool;

the fabric is selected from the group consisting of 2/1, 3/1, and 2/2 twills; and the elastomeric ends are spandex.

8. The fabric of claim 6 wherein the spandex has a heat-set efficiency at approximately 175°–190° C. of ≧80%.

9. The fabric of claim 1 wherein:

the ratio of non-elastomeric ends to bare elastomeric ends is at least about 3:1; and the ratio of non-elastomeric ends to elastomeric ends is no greater than about 4:1.

10. The fabric of claim 1 wherein:

the elastomeric ends are present to an extent of at least about 1.5 percent by total fabric weight; and the elastomeric ends are present to an extent of no more than about 5 percent by total fabric weight.

* * * * *

UNITED STATES PATENT AND TRADEMARK OFFICE

CERTIFICATE OF CORRECTION

PATENT NO. : 6,659,139 B2
DATED : December 9, 2003
INVENTOR(S) : Graham H. Laycock et al.

It is certified that error appears in the above-identified patent and that said Letters Patent is hereby corrected as shown below:

Drawings,
Insert the attached replacement sheet 5 of 7, which includes FIGs. 15 and 16, wherein FIG. 15 has been corrected.

Signed and Sealed this

Twelfth Day of October, 2004

JON W. DUDAS
*Director of the United States Patent and Trademark Office*